US005904661A

United States Patent [19]

Bonz et al.

[11] Patent Number: 5,904,661

[45] Date of Patent: May 18, 1999

[54] BACK SCRATCHER WITH A MOVING ARM

[76] Inventors: Karen F. Bonz; Anthony S. Bonz, both of 25076 Virginia Ave., Lake Zurich, Ill. 60047

[21] Appl. No.: 08/896,607

[22] Filed: Jul. 18, 1997

[51] Int. Cl.[6] ..... A61H 7/00

[52] U.S. Cl. ..... 601/137; 601/136; 601/93; 601/95; 601/101; 601/103

[58] Field of Search ..... 601/136, 137, 601/138, 143, 144, 145, 146, 147, 84, 89, 93, 95, 97, 101, 103

[56] References Cited

U.S. PATENT DOCUMENTS

| | | | |
|---|---|---|---|
| D. 35,313 | 11/1901 | Wirt | 601/137 |
| D. 260,694 | 9/1981 | Mallett | D28/99 |
| 687,363 | 11/1901 | Wirt | 601/137 |
| 2,044,863 | 4/1936 | Sticht | 601/136 |
| 3,709,620 | 1/1973 | Miyamoto | 401/195 |
| 3,768,463 | 10/1973 | Curry | 601/137 |
| 3,884,224 | 5/1975 | Garcia . | |
| 4,014,051 | 3/1977 | Pettit . | |
| 4,071,021 | 1/1978 | Gallacci . | |
| 4,091,805 | 5/1978 | Clark | 601/137 |
| 4,285,101 | 8/1981 | Hanna | 24/3 |
| 4,574,788 | 3/1986 | Jordan | 601/137 |
| 4,915,096 | 4/1990 | Winstone et al. . | |
| 5,479,951 | 1/1996 | Denebeim | 132/265 |

OTHER PUBLICATIONS

Telescoping Back Scratcher, Harriet Carter ®Catalog, North Whales, PA.

*Primary Examiner*—Richard J. Apley
*Assistant Examiner*—Benjamin K. Koo
*Attorney, Agent, or Firm*—David L. Volk

[57] ABSTRACT

A telescoping arm comprises a distal end and a proximal end. A head portion is adapted to contact a human back, and is configured to connect to the distal end of the arm. A base is configured to connect to the proximal end of the arm. The base comprises a first drive and a second drive. In one embodiment, the first drive is configured to move the arm in an alternating lateral motion. In another embodiment, the first drive is configured to move the arm in an alternating pivoting motion. The second drive is configured to alternately extend and retract the arm. A single motor may be coupled to both of the first and second drives, or each drive may include a separate motor. The first and second drives are configured to operate simultaneously. A clip is attachable to the base, for removably attaching the base to a stable object. An inverted cradle shaped base extension is also attachable to the base, for resting the back scratcher on a sofa arm.

12 Claims, 2 Drawing Sheets

BACK SCRATCHER WITH A MOVING ARM

BACKGROUND OF THE INVENTION

1. Field of the Invention

The present invention relates to back scratchers, particularly to back scratchers with moving arms.

2. Description of the Related Art

Most back scratchers are manually operated. Those that have motorized movement are limited in the motion that they provide, and are cumbersome to use. What is needed is a back scratcher which can be mounted in a convenient location for hands free use, and which provides a comfortable, "all-over" back scratch by simulating human arm movements.

SUMMARY OF THE INVENTION

The back scratcher of the present invention includes a telescoping arm having a distal end and a proximal end. A head portion is adapted to contact a human back, and is configured to connect to the distal end of the arm. A base is configured to connect to the proximal end of the arm. The base comprises a first drive and a second drive. In one embodiment, the first drive is configured to move the arm in an alternating lateral motion. In another embodiment, the first drive is configured to move the arm in an alternating pivoting motion. The second drive is configured to alternately extend and retract the arm. A single motor may be coupled to both of the first and second drives, or each drive may include a separate motor. The first and second drives are configured to operate simultaneously; thus providing a comfortable, "all-over" back scratch which simulates human arm movements. A clip is attachable to the base, for removably attaching the base to a stable object. An inverted cradle shaped base extension is also attachable to the base, for resting the back scratcher on a sofa arm. The clip and the base extension permit the back scratcher of the present invention to be mounted in a convenient location for hands free use.

Still further features and advantages will become apparent from the ensuing description and drawings.

DETAILED DESCRIPTION

Figure 1:
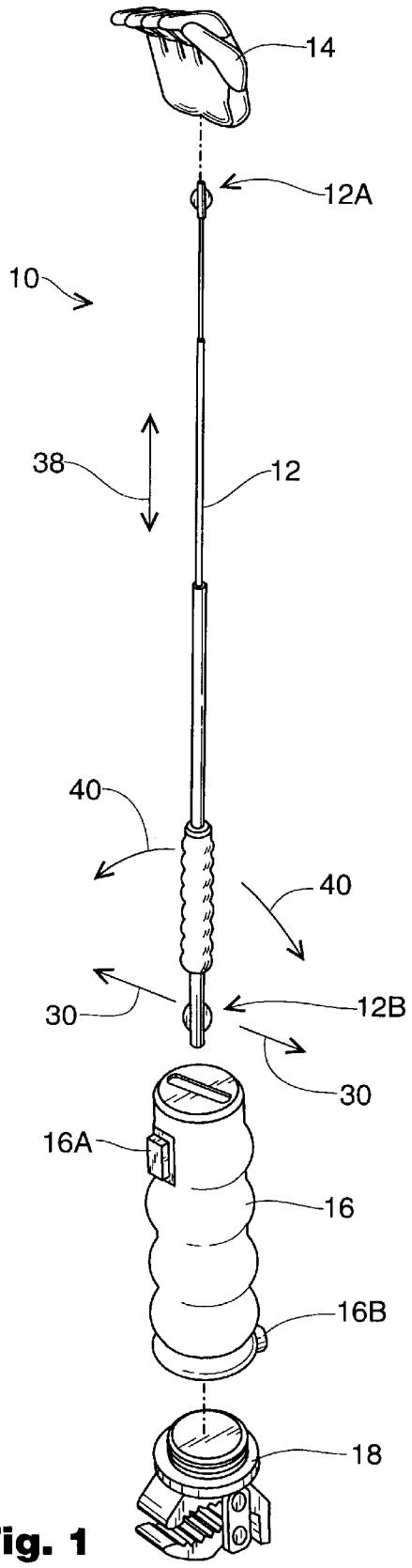
FIG. 1 is a perspective view of a back scratcher of the present invention.

FIG. 1 is a perspective view of a back scratcher 10 of the present invention. The back scratcher 10 includes a telescoping arm 12 having a distal end 12A and a proximal end 12B. A head portion 14, which in this figure resembles a human hand, is provided to contact a human back (not shown), to provide a scratching effect. A base 16 is configured to connect to the proximal end 12B of the arm 12. A clip 18 is attachable to the base 16, for removably attaching the base 16 to a stable object. A power switch 16A is provided to energize the back scratcher 10. The back scratcher 10 is powered by one or more batteries (not shown). A plug adapter 16B may be provided to permit operation from standard alternating current.

Figure 2:
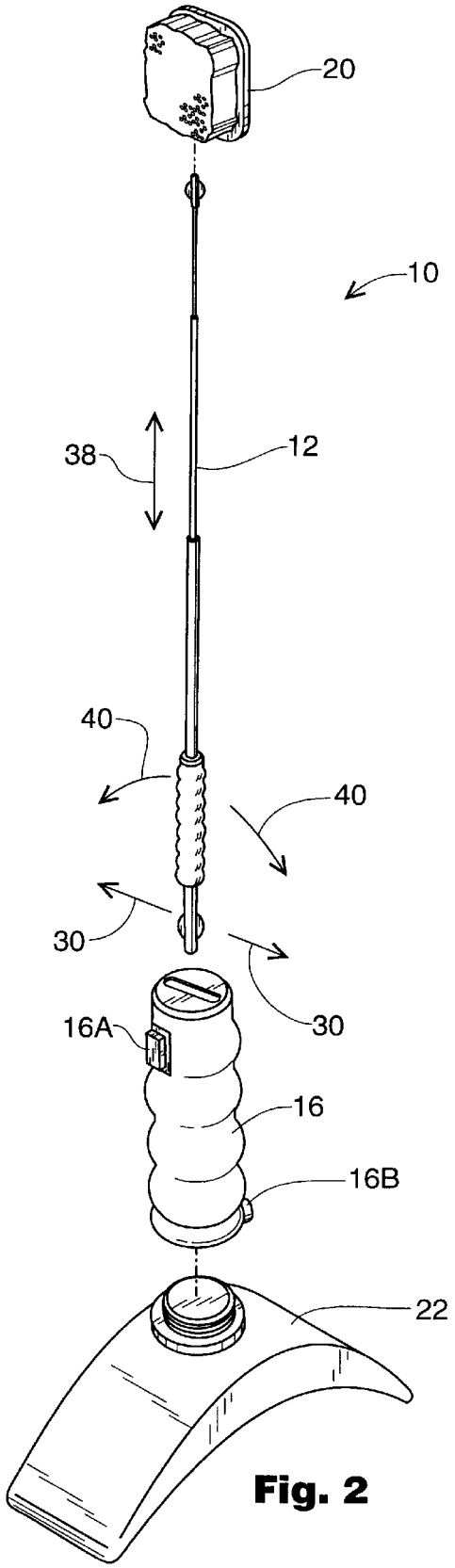
FIG. 2 is a perspective view of the back scratcher, showing different accessories.

FIG. 2 is a perspective view of the back scratcher, showing different accessories. In this view, an alternate head portion 20 is provided, which is configured as a brush. Any other suitable configuration is within the scope of the present invention. Also in this view, an inverted cradle shaped base extension 22 is attachable to the base 16, for resting the back scratcher 10 on a sofa arm (not shown).

Figure 3:
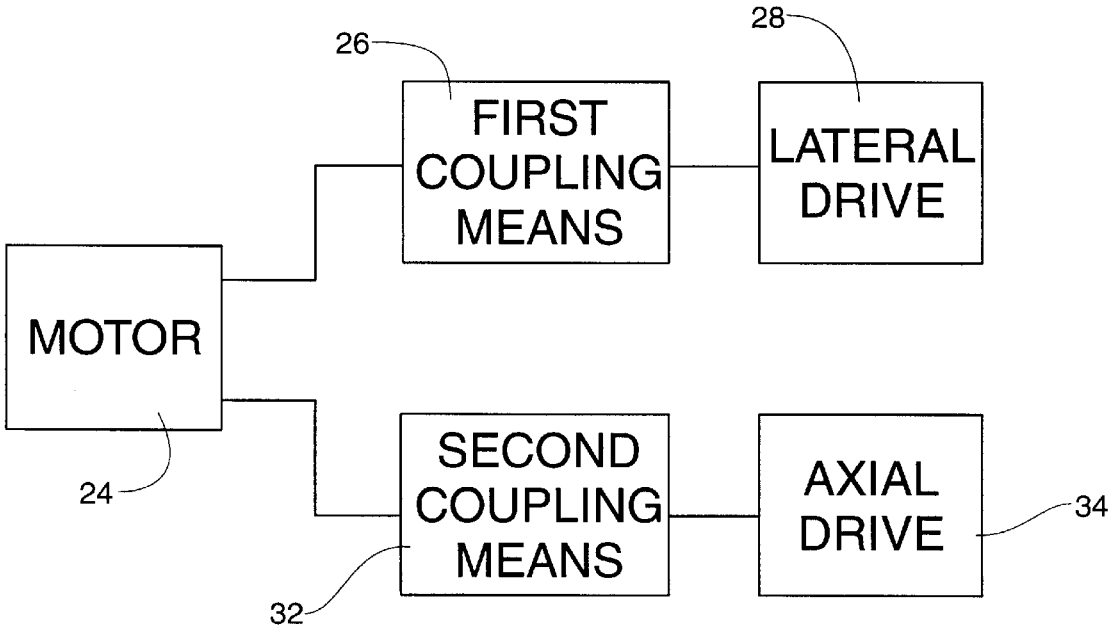
FIG. 3 is a block schematic diagram of a first embodiment of the back scratcher.

FIG. 3 is a block schematic diagram of a first embodiment of the back scratcher 10. Referring to FIG. 3, as well as FIG. 1 or 2, the base 16 includes a motor 24, which is coupled through a first coupling means 26 to a lateral drive 28. The lateral drive 28 is configured to drive the arm 12 in an alternating lateral motion, as indicated by arrows 30 in FIGS. 1 and 2.

The motor 24 is also coupled through a second coupling means 32 to an axial drive 34. The axial drive 34 is configured to alternately extend and retract the arm 12, as indicated by the arrows 38 in FIGS. 1 and 2. The lateral drive 28 and the axial drive 34 operate simultaneously.

Figure 4:
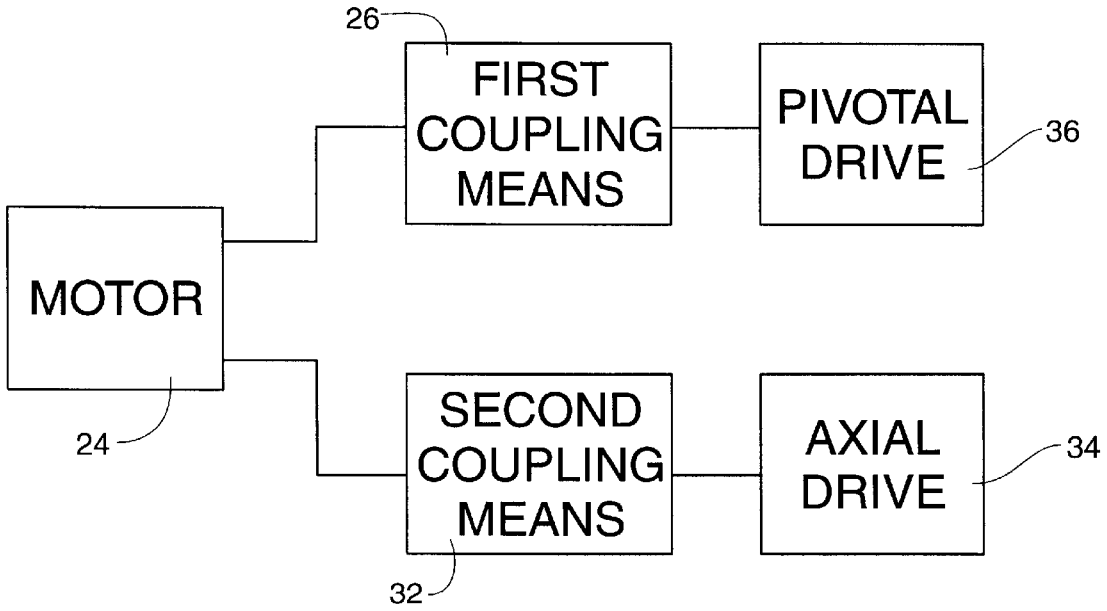
FIG. 4 is a block schematic diagram of a second embodiment of the back scratcher.

FIG. 4 is a block schematic diagram of a second embodiment of the back scratcher 10. It is similar to FIG. 3, except that the lateral drive 28 is replaced by a pivotal drive 36. The pivotal drive 36 is configured to drive the arm 12 in an alternating pivoting motion, as indicated by arrows 40 in FIGS. 1 and 2.

Although both FIGS. 3 and 4 show a single motor operating both drives, the present invention could be accomplished with each drive having its own motor. In such an embodiment, the motors themselves could reverse direction, or the reversal of axial, lateral and pivoting motions could be accomplished with appropriate gearing.

The actual structure necessary to accomplish the lateral, pivotal, and axial motions of the arm 12 are well known in the art. The axial motion can be accomplished with structure similar to a conventional power antenna on an automobile. The pivotal motion can be accomplished with structure similar to a metronome. The lateral motion may be accomplished via a belt and pulley system, or any of numerous well known means. The present invention may be used manually by gripping the base 16 and manipulating the back scratcher 10 in a conventional manner.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A back scratcher comprising:

a. a head portion adapted to contact a human back;

b. a telescoping arm having a distal end and a proximal end;

c. the head portion configured to connect to the distal end of the arm;

d. a base configured to connect to the proximal end of the arm;

e. the base comprising a first drive and a second drive;

f. the first drive configured to move the arm in an alternating lateral motion;

g. the second drive configured to alternately extend and retract the arm; and h. the first drive and the second drive configured to operate simultaneously.

2. The back scratcher of claim 1, further comprising a motor, and wherein the first and second drive are both coupled to the motor.

3. The back scratcher of claim 2, further comprising a clip adapted for removably attaching the base to a stable object.

4. The back scratcher of claim 2, further comprising a base extension having an inwardly curvate surface adapted for resting the back scratcher on a sofa arm.

5. The back scratcher of claim 1, further comprising a clip adapted for removably attaching the base to a stable object.

6. The back scratcher of claim 1, further comprising a base extension having an inwardly curvate surface adapted for resting the back scratcher on a sofa arm.

7. A back scratcher comprising:

a. a head portion adapted to contact a human back;

b. a telescoping arm having a distal end and a proximal end;

c. the head portion configured to connect to the distal end of the arm;

d. a base configured to connect to the proximal end of the arm;

e. the base comprising a first drive and a second drive;

f. the first drive configured to move the arm in an alternating pivoting motion; and g. the second drive configured to alternately extend and retract the arm; and h. the first drive and the second drive configured to operate simultaneously.

8. The back scratcher of claim 7, further comprising a motor, and wherein the first and second drive are both coupled to the motor.

9. The back scratcher of claim 8, further comprising a clip adapted for removably attaching the base to a stable object.

10. The back scratcher of claim 8, further comprising a base extension having an inwardly curvate surface adapted for resting the back scratcher on a sofa arm.

11. The back scratcher of claim 7, further comprising a clip adapted for removably attaching the base to a stable object.

12. The back scratcher of claim 7, further comprising a base extension having an inwardly curvate surface adapted for resting the back scratcher on a sofa arm.

* * * * *